US007140222B2

(12) United States Patent
Park et al.

(10) Patent No.: US 7,140,222 B2
(45) Date of Patent: Nov. 28, 2006

(54) APPARATUS AND METHOD FOR UNIFORM SHEAR DEFORMATION

(75) Inventors: Jong Woo Park, Seoul (KR); Young Hoon Chung, Seoul (KR)

(73) Assignee: Korea Institute of Science and Technology (KR)

( * ) Notice: Subject to any disclaimer, the term of this patent is extended or adjusted under 35 U.S.C. 154(b) by 77 days.

(21) Appl. No.: 10/984,220

(22) Filed: Nov. 9, 2004

(65) Prior Publication Data

US 2005/0097936 A1 May 12, 2005

(30) Foreign Application Priority Data

Nov. 11, 2003 (KR) ..... 10-2003-0079548

(51) Int. Cl.
*B21C 23/00* (2006.01)

(52) U.S. Cl. ..... 72/262; 72/253.1; 72/270

(58) Field of Classification Search ..... 72/253.1, 72/256, 262, 270, 282, 289
See application file for complete search history.

(56) References Cited

U.S. PATENT DOCUMENTS 6,370,930 B1 * 4/2002 Lee et al. ..... 72/262
6,571,593 B1 * 6/2003 Chung et al. ..... 72/262
6,895,795 B1 * 5/2005 Chaudhury et al. ..... 72/262

OTHER PUBLICATIONS

"An Experimental Study of Equal Channel Angular Extrusion", Scripta Materialia, vol. 37, No. 4, 1997, pp. 437-442.

"Processing Nanostructured Materials: An Overview", Journal of Metals, Dec. 2000, pp. 41-45.

"Effect of Die Shape on the Deformation Behavior in Equal-Channel Angular Pressing", Metallurgical and Materials Transactions A, vol. 32A, Dec. 2001, pp. 3007-3014.

* cited by examiner

*Primary Examiner*—Ed Tolan
(74) *Attorney, Agent, or Firm*—Ostrolenk, Faber, Gerb & Soffen, LLP

(57) ABSTRACT

A shear deformation apparatus comprises: a die having an inlet and an outlet; and a rotatable device installed at a shear zone for supporting a material introduced into the inlet of the die and thus changing a direction of the material to the outlet of the die, of which the surface moves together with the material. According to the apparatus, a frictional resistance between the material and the die is reduced and a generation of a dead zone is prevented, thereby reducing a deformation resistance and having a uniform shear deformation.

8 Claims, 11 Drawing Sheets

APPARATUS AND METHOD FOR UNIFORM SHEAR DEFORMATION

BACKGROUND OF THE INVENTION

1. Field of the Invention

The present invention relates to a shear deformation apparatus, and more particularly, to a shear deformation apparatus capable of reducing a deformation resistance and a friction resistance and having a uniform shear deformation, which results in additional effects of reduction in running power and cost.

2. Description of the Conventional Art

As shown in FIG. 1, a shear deformation apparatus generally known as an equal channel angular apparatus comprises: a die 1 in which an inlet channel 2 and an outlet channel having the same sectional area are crossed each other with an 'L ' shape; and a pressurizing tool (not shown) for putting a material 3 into the inlet channel 2, then pressurizing and extruding to the outlet channel 4.

When a metallic material is put into an inlet 21 of the shear deformation apparatus and then extruded to an outlet 41, a change in material flow occurs at the intersection of the inlet and outlet channel. This process causes a shear deformation with a shear angle, θ. As the result, the microstructure of the material becomes fine, thereby improving mechanical properties such as strength and formability (Refer to Journal of Metals, 1998, June, Pages 41 to 45).

Under an ideal circumstance having no friction, a shear deformation with θ is generated in the deformed material 5. As there is no change in the cross sectional area of the material during processing, very fine microstructure can be obtained by repeating the process.

However, in the conventional method, the ideal circumstance with no friction can not be obtained even if a lubricant is deposited to an inner wall of the inlet path 2 and the outlet path 4. As a result, as shown in FIG. 2, a non-uniform deformation that the shear angle varies depending on a position is generated, thereby resulting in inhomogeneous structure and properties. Especially, the flow of the material becomes slow at a bottom surface due to a severe friction resistance which causes the material to lag behind to a great degree (Refer to Scripta materiallia, Vol. 37, No. 4, 1997, pages 437 to 442).

Moreover, as shown in FIG. 3, there is a severe deformation resistance and a high frictional resistance at the corner of the die, and a dead zone 6 is generated at this corner where the material is adhered instead of being deformed. This requires an equipment of a high power and a high cost in order to overcome the high resistance of the material flow in the dead zone.

In order to lower a deformation resistance of the dead zone, a method for increasing a die angle Φ was proposed as shown in FIG. 4. In this case, however, since the amount of shear deformation decreases, the microstructure refining effect of the material reduces. Additionally, since the number of repeated processes has to be increased in order to increase the amount of shear deformation, a productivity lowers.

As another method for lowering the deformation resistance and inhomogeneous deformation, the outer edge is made to be round, as shown in FIG. 5, in order to reduce the dead zone. However, in this method, too, the amount of shear deformation of the entire material decreases. In addition, the material near the bottom surface can scarcely have shear deformation, as shown in FIG. 6, even in the ideal state having no friction, thereby causing a problem that the structure and properties of the material become non-uniform. Especially at the bottom surface of the material, deformation becomes very inhomogeneous according to a position since there is little shear deformation owing to a geometric effect of the round edge and frictional lag of the material flow on the contact surface, thereby resulting in a non-uniform material characteristics (Refer to Matallurgical and Materials Transactions 32A, December, 2002, pages 3007 to 3014).

SUMMARY OF THE INVENTION

Therefore, an object of the present invention is to provide a shear deformation apparatus capable of reducing a frictional resistance between a material and a die, reducing a deformation resistance by preventing a dead zone from occurring, and having a uniform shear deformation.

To achieve these and other advantages and in accordance with the purpose of the present invention, as embodied and broadly described herein, there is provided a shear deformation apparatus comprising: a die having an inlet and an outlet; and a rotatable device installed at a shear zone for supporting a material introduced into the inlet of the die and thus changing the direction of the material to the outlet of the die, and of which the surface moves with the material.

The rotatable device is a roller installed at the shear zone.

The roller is effectively made to have a groove to cover the material.

The moving device can also be constructed as a rotary belt.

In addition, two or more shear zones can be made using three or more channels with several intersections and the rotatable device can be respectively installed at the shear zone of the intersections.

It is preferable to further comprise a driving unit for driving the rotatable device.

It is effective to further comprise a control unit for controlling a speed of the rotatable device.

To achieve these and other advantages and in accordance with the purpose of the present invention, as embodied and broadly described herein, there is also provided a shear deformation method for changing a moving direction of a material at a shear zone, wherein a part of the rotatable device moves together with the material thus to help the material deform and flow easily at the shear zone.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 1 to 6 show a structure of a shear deformation apparatus in accordance with the conventional art; in which FIG. 1 is a front section view of a shear deformation apparatus;

FIG. 2 is a front view showing a test result of a shear deformation of the shear deformation apparatus of FIG. 1;

FIG. 3 is a front section view showing that a dead zone was generated at the corner of the channel in the shear deformation apparatus of FIG. 1;

FIG. 4 is a modification example of the shear deformation apparatus of FIG. 1;

FIG. 5 is another modification example of the shear deformation apparatus of FIG. 1;

FIG. 6 is a front view showing a test result of a shear deformation of the shear deformation apparatus of FIG. 5;

FIGS. 7 and 8 show a structure of a first embodiment of the present invention; in which FIG. 7 is a front section view of a shear deformation apparatus;

FIG. 8 is a side view of the shear deformation apparatus of FIG. 7;

DETAILED DESCRIPTION OF THE PREFERRED EMBODIMENTS

Figure 1:
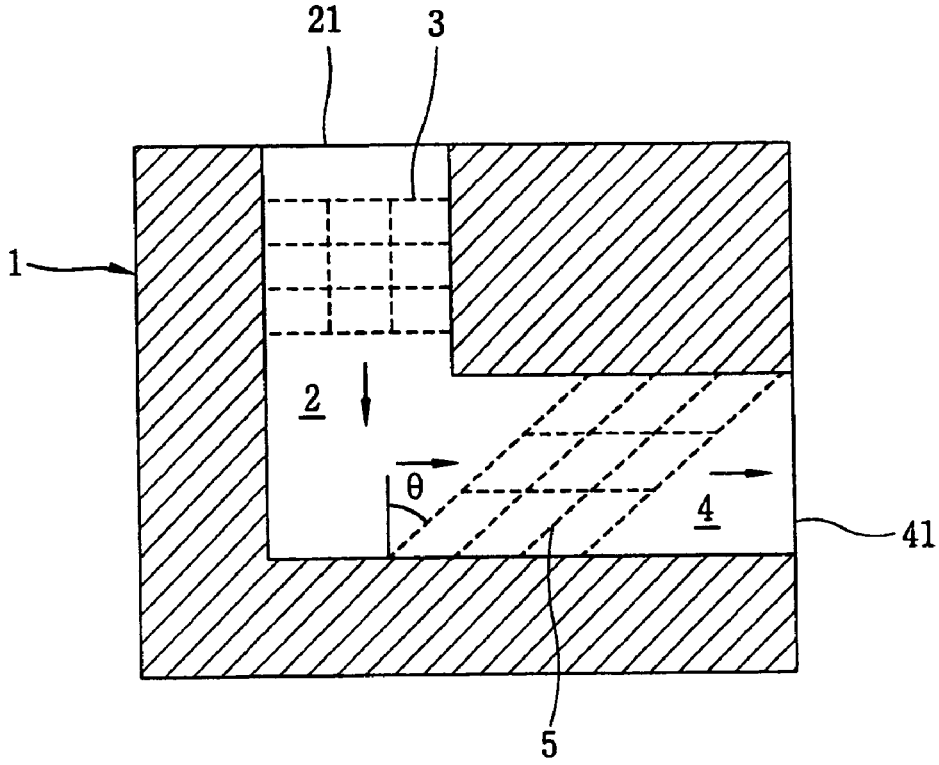
Figure 2:
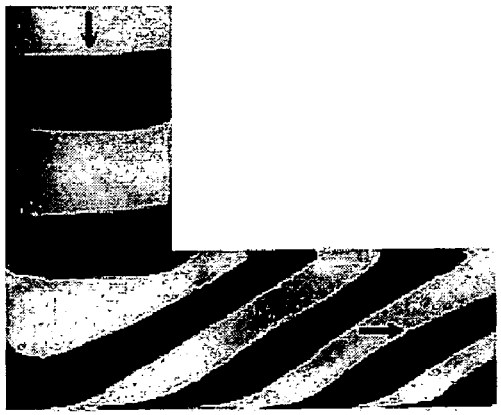
Figure 3:
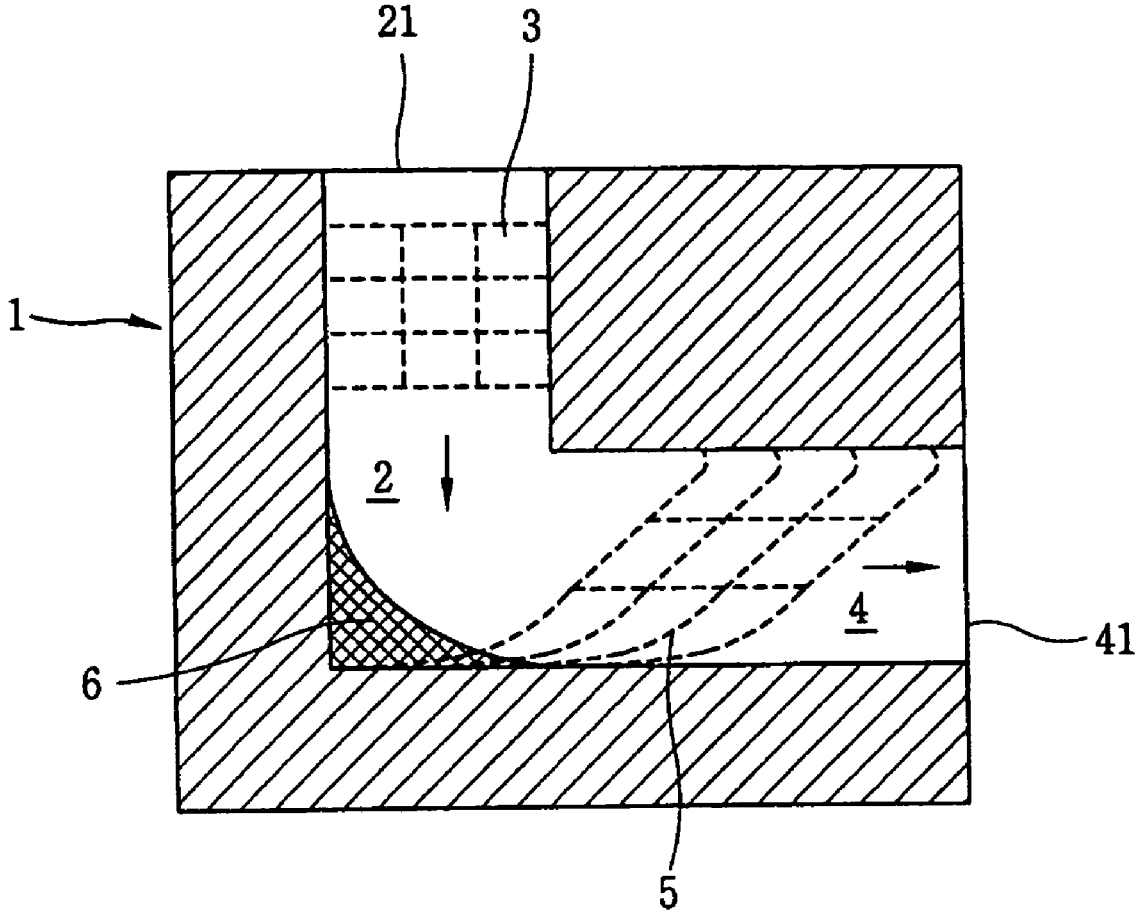
Figure 4:
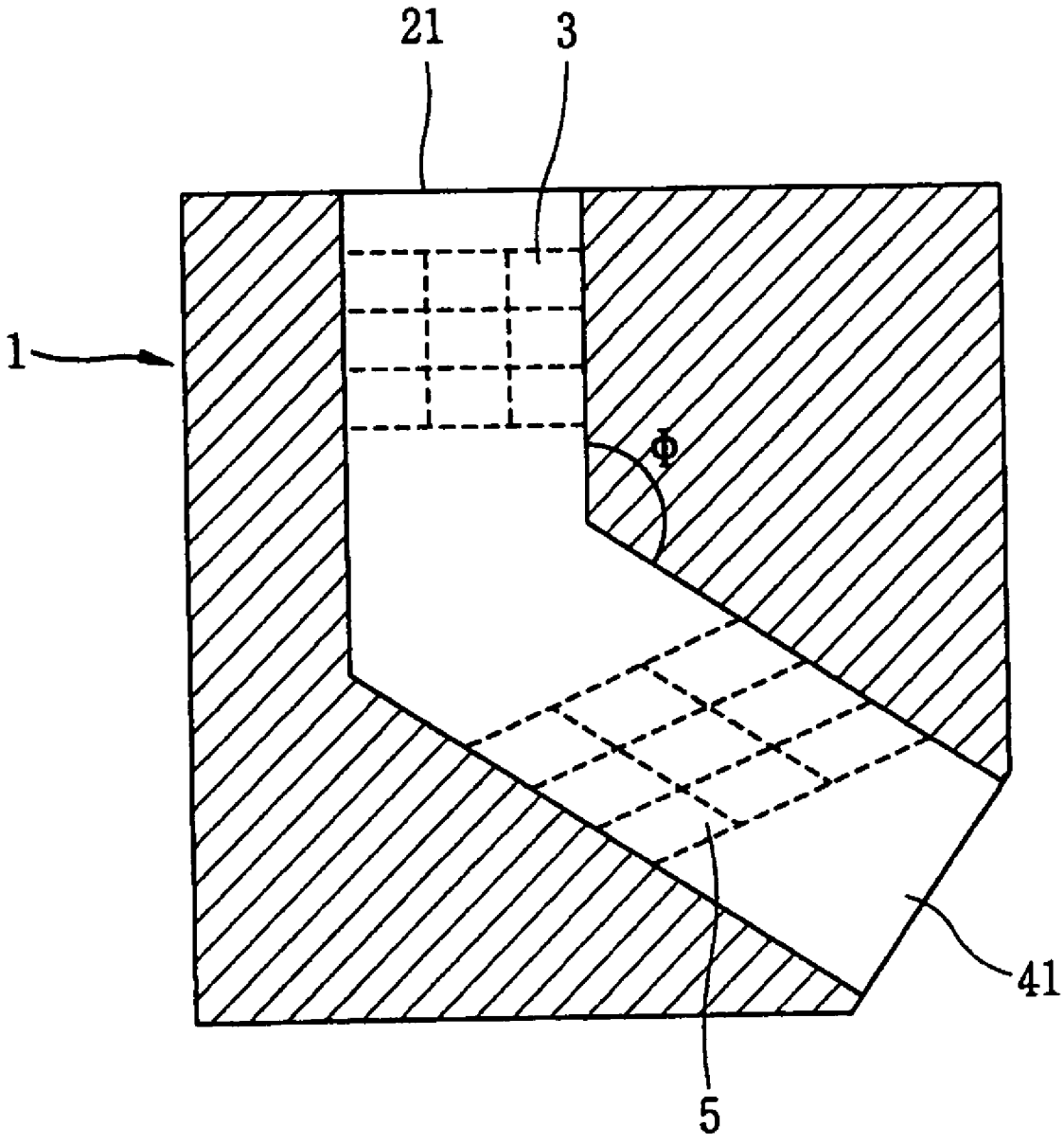
Figure 5:
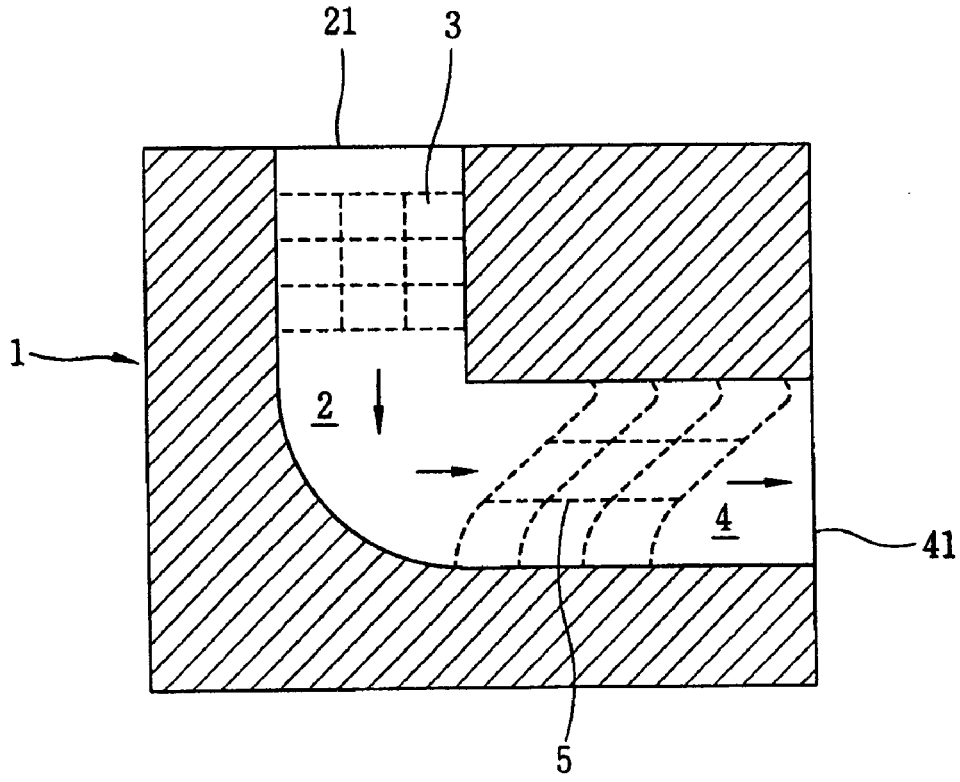
Figure 6:
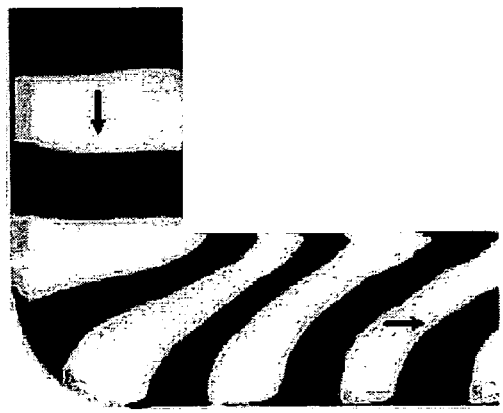

Reference will now be made in detail to the preferred embodiments of the present invention, examples of which are illustrated in the accompanying drawings.

Hereinafter, preferred embodiments of the present invention will be explained.

The same reference numerals will be given to the aforementioned construction parts, and details will be omitted.

Figure 7:
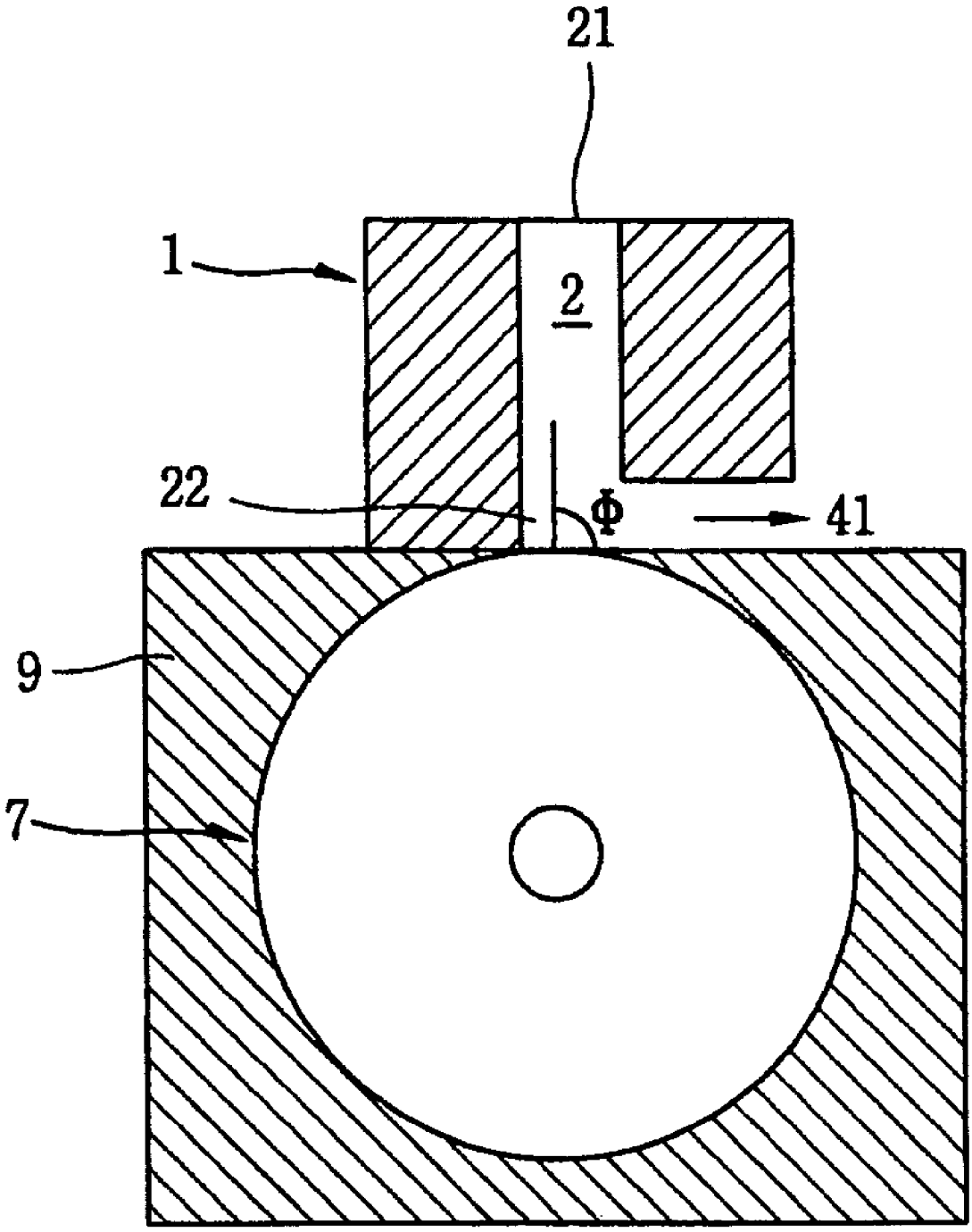
Figure 8:
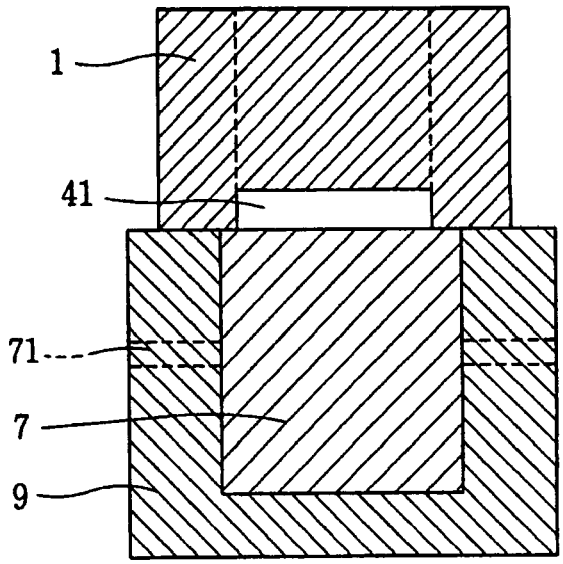

FIGS. 7 and 8 show a structure of a first embodiment of the present invention; in which FIG. 7 is a front section view of a shear deformation apparatus and FIG. 8 is a side view of the shear deformation apparatus of FIG. 7.

As shown, the shear deformation apparatus according to the first embodiment of the present invention comprises: a die 1 having an inlet 21 and an outlet 41; and a lower structure 9 for supporting the die 1 at a lower portion; and a rotatable device 7 installed at a shear zone 22 for supporting a material introduced into the inlet 21 of the die 1 and thus changing a direction of the material to the outlet 41 of the die 1, and of which the surface moves together with the material.

The rotatable device is a roller 7 installed at the lower structure 9 by a rotation shaft 71. The roller 7 is rotatably installed at the lower structure 9 without an additional driving unit and thereby can rotate together when the material is moved. Also, the roller 7 can work with a driving unit (not shown) for driving the roller 7 to be forcibly rotatable and a control unit (not shown) for controlling a speed of the roller 7.

Figure 9:
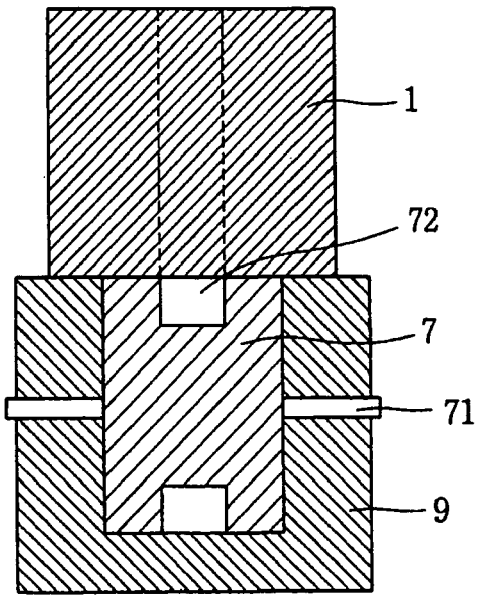
FIG. 9 is a side view showing a modification example of a roller of FIG. 8.
Figure 10:
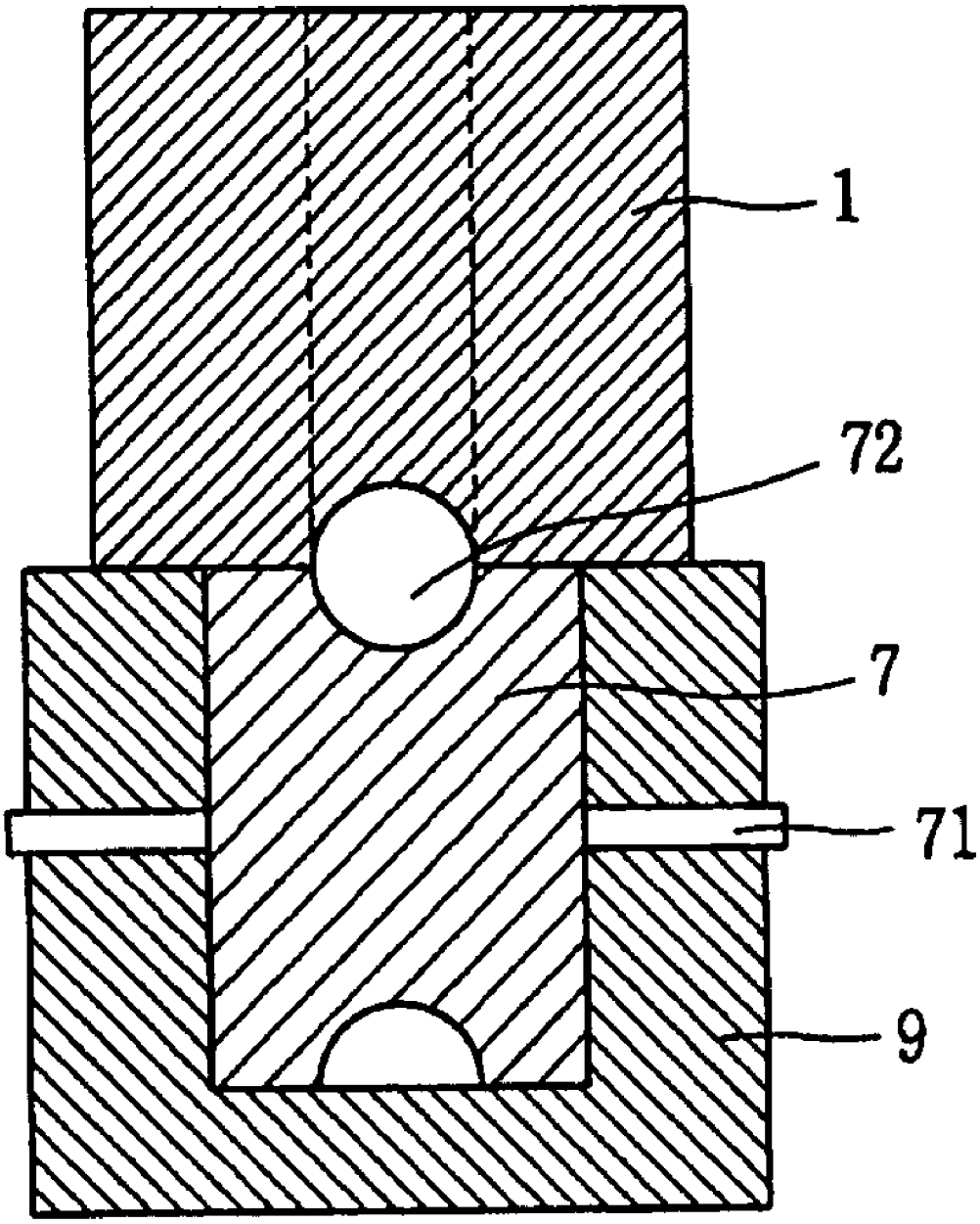
FIG. 10 is a side view showing another modification example of the roller of FIG. 8.
Figure 11:
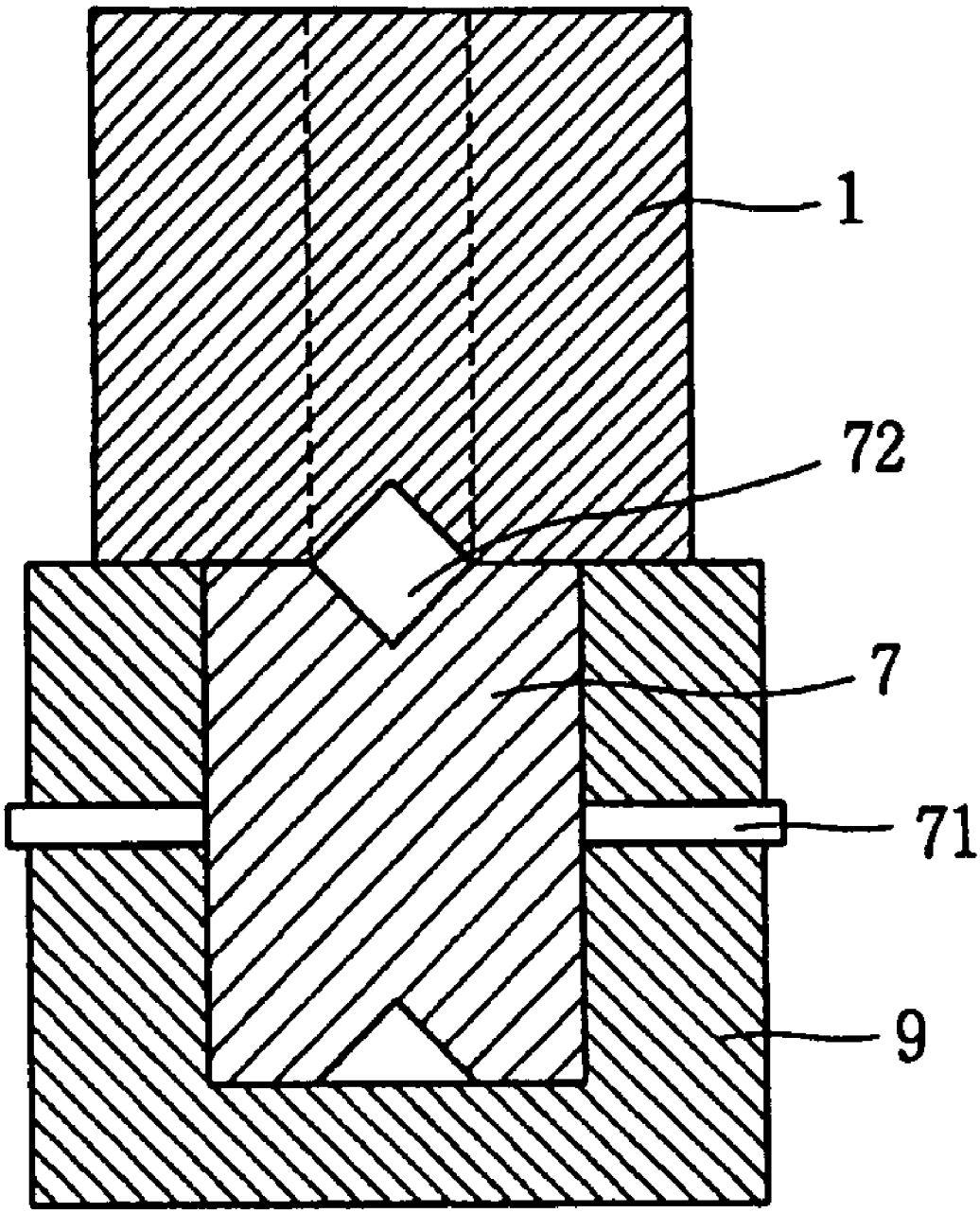
FIG. 11 is a side view showing still another modification example of the roller of FIG. 8.

Also, preferably, the roller 7 is made to have a shape of a groove on the surface thereof to cover a material. In FIG. 9, the roller 7 is concaved as a square shape in order to cover a lateral surface and a lower surface of a rectangular material. Likewise, in case that a sectional surface of the material has a circular shape as shown in FIG. 10, a sectional outer surface of the roller 7 is preferably concaved as a semicircular shape. Also, in case that a sectional surface of the material has a diamond shape as shown in FIG. 11, the sectional outer surface of the roller 7 is desirably concaved as a triangle shape.

Operation of the first embodiment of the present invention will be explained.

First, a moving direction of a material introduced into the inlet 21 changes at the intersection with an 'L' shape and thereby a shear deformation occurs. Then, the material is extruded to the outlet 41 moving along with the surface of the roller 7 that rotates with the same speed as the moving speed of the material. Therefore, differently from the conventional method, a dead zone that the material is adhered to the corner of the shear zone 22 is not generated, and an area that directly comes in contact with the die 1 decreases greatly thus to significantly reduce both deformation resistance and friction resistance, thereby having a uniform shear deformation.

Herein, the amount of shear deformation $\gamma$ is expressed as the following equation 1, which depends on the angle $\Phi$ between inlet and outlet channel of the die.

$$\gamma=2\cot(\Phi/2) \qquad \text{Equation 1}$$

The angle $\Phi$ and the amount of shear deformation $\gamma$ vary with the position that the material comes in contact with the surface of the roller 7. That is, the nearer the material supply direction is to a center axis of the roller 7, the greater the amount of shear deformation becomes. However, if the material supply direction is near to the center axis of the roller 7, high force is required for shear deformation.

In the first embodiment of the present invention, rotation of the roller 7 can also be assisted by using an additional driving unit (not shown), and the rotation speed can be adjusted. In this case, the same rotation speed as the material supply speed is obtained easily by adjusting the speed of the roller 7 with the driving unit. Therefore, inhomogeneous shear deformation, which may be generated at the bottom region of the material when the rotation speed of the roller 7 is much different from the material supply speed, is removed.

Also, a groove is formed on the roll surface to cover the material, thereby greatly reducing an area that the material comes in contact with the die. According to this, a frictional resistance can be reduced and at the same time, deformation can be uniformly performed even at both the bottom and lateral surface.

Figure 12:
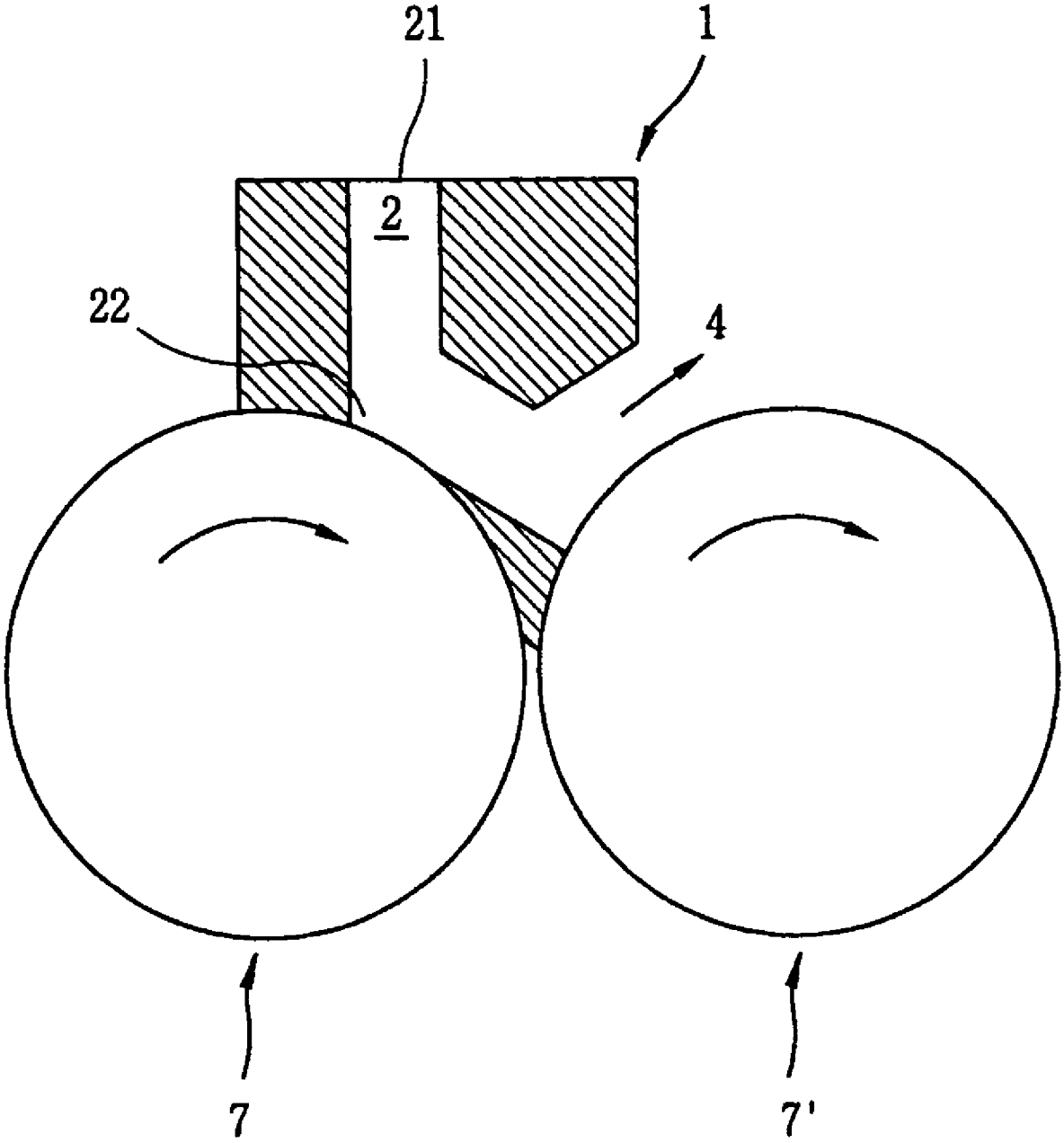
FIG. 12 is a front view of a shear deformation apparatus according to a second embodiment of the present invention.

FIG. 12 is a front view of a shear deformation apparatus according to a second embodiment of the present invention.

As shown, in the shear deformation apparatus according to the second embodiment of the present invention, two shear zones 22 are formed and the roller 7 is respectively installed at the shear zones 22. In the shear deformation apparatus according to the second embodiment of the present invention, shear deformation is performed several times with one time processing and thereby a high shear deformation can be easily obtained even with small friction resistance and deformation resistance.

Figure 13:
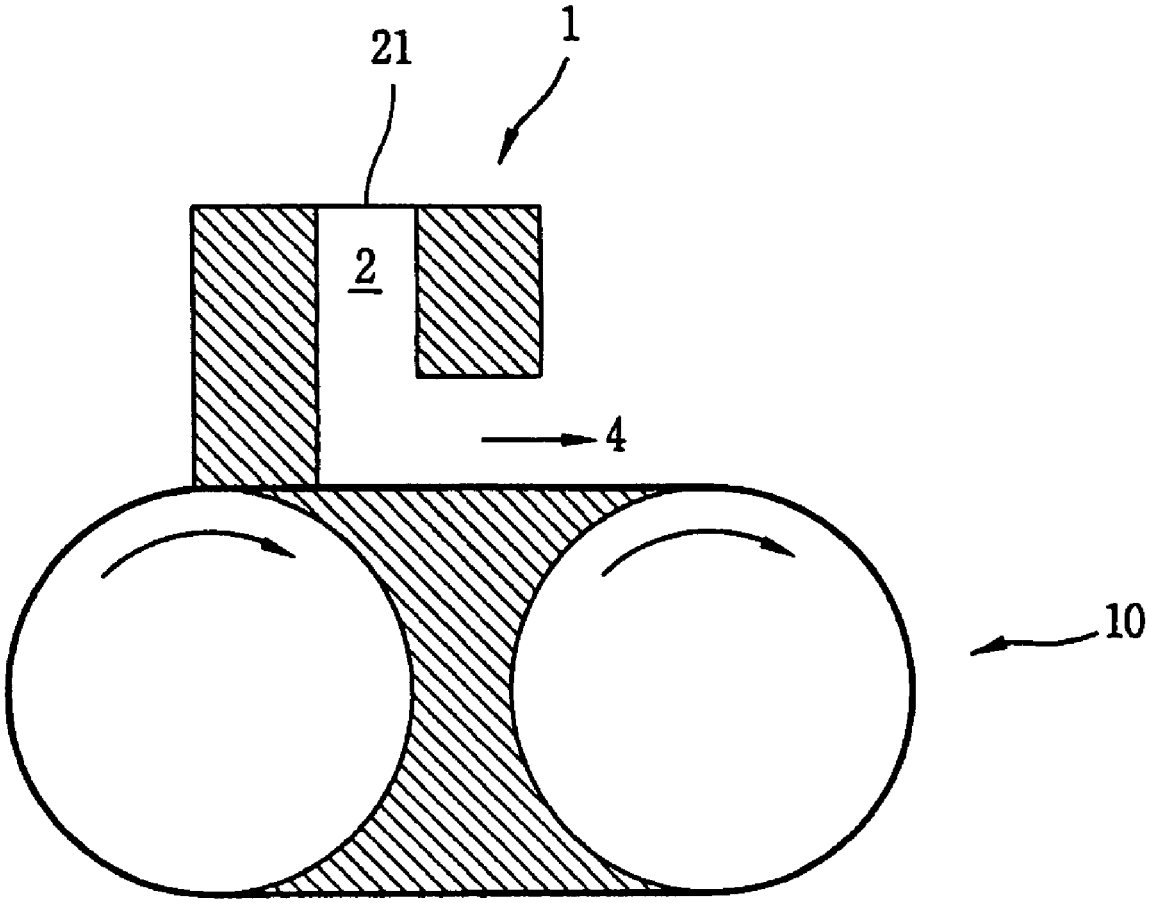
FIG. 13 is a front view of a shear deformation apparatus according to a third embodiment of the present invention.

FIG. 13 shows a structure of a third embodiment of the present invention, in which a construction of a rotatable device is different from that of the first embodiment.

That is, the rotatable device is constructed as the roller 7 in the first embodiment, whereas the feeding device is constructed as a rotary belt 10 in the third embodiment. Except this difference, the rest constructions of the third embodiment are the same as those of the first embodiment and thereby the operational effects are the same.

Figure 14:
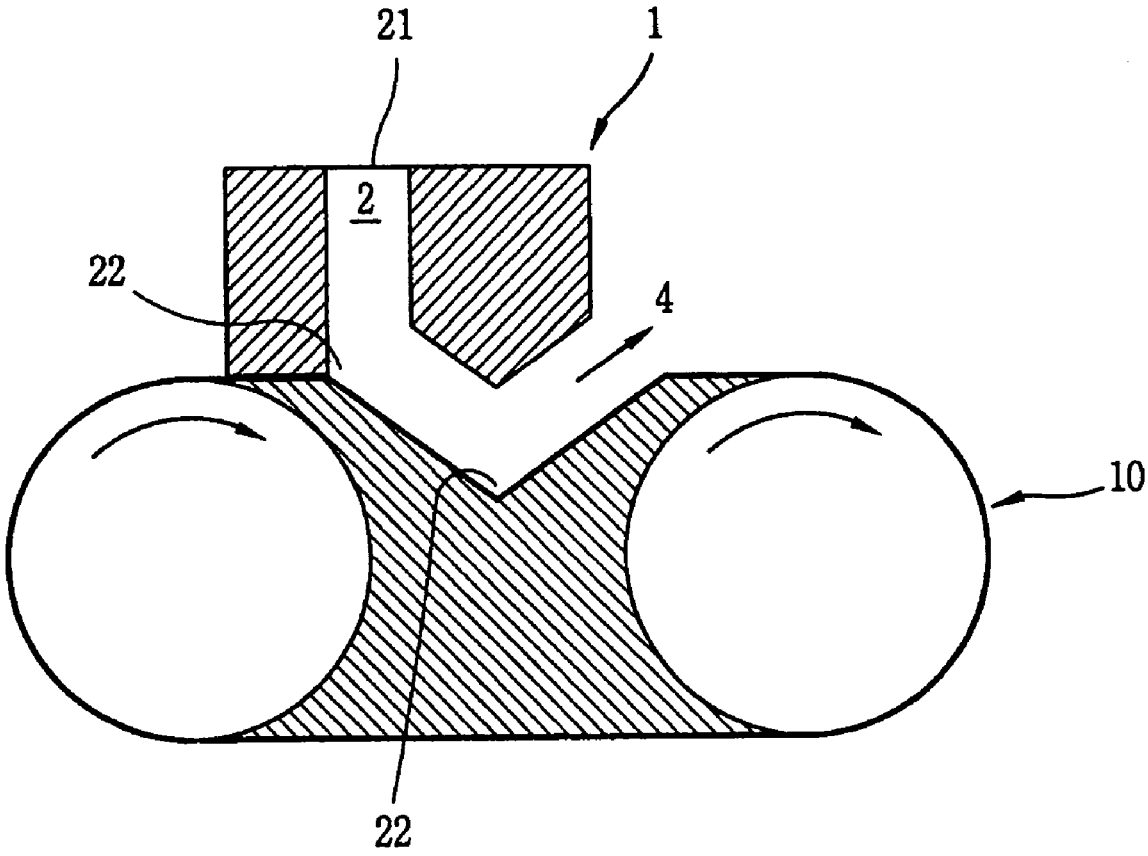
FIG. 14 is a front view of a shear deformation apparatus according to a fourth embodiment of the present invention.

FIG. 14 shows a structure of a fourth embodiment of the present invention, in which a construction of a rotatable device is different from that of the second embodiment.

That is, the rotatable device is constructed as a set of rollers 7, 7' in the second embodiment, whereas the feeding device is constructed as a rotary belt 10 between a set of rollers in the fourth embodiment. That is, the rotary belt 10 is constructed to be bent at said two shear zones 22. Except this difference, the rest constructions of the fourth embodiment are the same as those of the second embodiment and thereby the operational effects are the same.

As depicted above, the present invention has the following advantages.

First, in the shear deformation apparatus according to the present invention, the friction resistance between the material and the die is reduced, the deformation resistance is reduced by preventing the dead zone from occurring, and a uniform shear deformation can be obtained.

Also, the amount and homogeneity of shear deformation can be easily controlled by adjusting the roll position and using the driving unit and the control unit.

Besides, the friction resistance can be more decreased by forming a groove on the roller or a groove type rotary belt to have a shape to cover the material.

Additionally, a high shear deformation can be obtained with small friction resistance and deformation resistance by forming at least two shear zones and then installing the rotatable device at the respective shear zones.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A shear deformation apparatus comprising:

a die having an inlet and an outlet;

a rotatable device installed at a shear zone in a manner which supports a material introduced into the inlet of the die and changes a moving direction of the material to the outlet of the die, the rotatable device including a surface which moves together with the material;

a driving unit for driving the rotatable device; and a control unit for controlling a speed of the rotatable device.

2. The apparatus of claim 1, wherein the rotatable device is a roller installed at the shear zone.

3. The apparatus of claim 2, wherein a groove on the roller is formed to cover the material.

4. The apparatus of claim 1, wherein the rotatable device is a rotary belt.

5. The apparatus of claim 4, wherein a groove type rotary belt is used to cover the material.

6. The apparatus of claim 1, wherein at least two shear zones are made and the rotatable device is respectively installed at the zones.

7. A shear deformation apparatus comprising:

a die having an inlet and an outlet;

a roller rotatably installed at a shear zone in a manner which supports a material introduced into the inlet of the die and changes a moving direction of the material to the outlet of the die;

a driving unit for driving the roller; and a control unit for controlling a speed of the roller, wherein a groove on the roller is formed to cover the material, at least two shear zones are made, and the roller is respectively installed at the shear zones.

8. A shear deformation apparatus comprising:

a die having an inlet and an outlet;

a rotary belt constructed to support a material introduced into the inlet of the die and change a moving direction of the material to the outlet of the die;

a driving unit for driving the rotary belt; and a control unit for controlling a speed of the rotary belt, wherein a groove type rotary belt is used to cover the material, at least two shear zones are formed, and the rotary belt is respectively installed at the shear deformation portions.

* * * * *